US006321052B1

(12) United States Patent
Yamashina et al.

(10) Patent No.: US 6,321,052 B1
(45) Date of Patent: Nov. 20, 2001

(54) METHOD AND APPARATUS FOR CORRECTING RUNNING STATE AND TENSION FOR AN ENDLESS BELT IN AN IMAGE-FORMING APPARATUS

(75) Inventors: Susumu Yamashina; Itaru Sato; Mitsuaki Kuroda; Kohyu Shigemori; Kazuo Takano; Seiichi Takayama; Naoto Nishi; Norio Hokari; Takashi Hoshino; Kozo Tagawa; Satoru Nishikawa; Yoshihiko Mitamura, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/588,068

(22) Filed: Jun. 6, 2000

(30) Foreign Application Priority Data

Sep. 8, 1999 (JP) ..... 11-253880

(51) Int. Cl.[7] ..... G03G 15/00; G03G 15/01; G03G 15/16

(52) U.S. Cl. ..... 399/165; 399/303; 399/308

(58) Field of Search ..... 399/162, 165, 399/302, 303, 308, 312, 313

(56) References Cited

U.S. PATENT DOCUMENTS 4,174,171 * 11/1979 Hamaker et al. ..... 399/165
4,462,676 * 7/1984 Shimura et al. ..... 399/165
5,467,171 * 11/1995 Castelli et al. ..... 399/162
5,659,851 * 8/1997 Moe et al. ..... 399/165
5,717,984 * 2/1998 Wong ..... 399/165
5,737,003 * 4/1998 Moe et al. ..... 399/165 X
5,754,932 * 5/1998 Tahara ..... 399/303
5,893,022 * 4/1999 Yoshino et al. ..... 399/302 X
5,907,746 * 5/1999 Kubota ..... 399/302 X
6,055,396 * 4/2000 Pang ..... 399/162 X
6,134,406 * 10/2000 Moe et al. ..... 399/165 X

FOREIGN PATENT DOCUMENTS 10-260590 9/1998 (JP) .
2000-75680 3/2000 (JP) .

* cited by examiner

*Primary Examiner*—Sandra Brase
(74) *Attorney, Agent, or Firm*—Oliff & Berridge, PLC

(57) ABSTRACT

An image-forming apparatus adjusts the running state of a belt by displacing one of the rolls supporting an endless belt, wherein the roll is displaced to prevent the belt from being twisted by a change in the tension of the endless belt that stems from the operation for displacing the roll. When the image-forming apparatus is provided with a belt running adjusting mechanism 20 which adjusts the running state of the endless belt 21 by displacing one (drive roll 22) of plural rolls supporting the belt 21 in the adjusting directions J, K, there is provided a tension correction mechanism 60 which corrects a change in the tension of the endless belt 21 that is caused by the operation of the belt running adjusting mechanism 20 for displacing the roll 22, by displacing, in the correction directions L, M, a contact member (tension roll 25) which is in contact with the belt 21 along the direction of width thereof.

14 Claims, 14 Drawing Sheets

85: TENSION ROLL (CONTACT MEMBER)

81: SHEET CONVEYER/TRANSFER BELT (ENDLESS BELT)

METHOD AND APPARATUS FOR CORRECTING RUNNING STATE AND TENSION FOR AN ENDLESS BELT IN AN IMAGE-FORMING APPARATUS

BACKGROUND OF THE INVENTION

1. Field of the Invention

The present invention relates to an image-forming apparatus as represented by a copying machine, a printer, a facsimile, a compounding machine or the like machine. More specifically, the invention relates to an image-forming apparatus equipped with an endless belt which runs being tightly stretched round plural rolls maintaining a high degree of correctness.

2. Prior Art

An image-forming apparatus such as a copying machine or printer is employing a belt running device in which, as shown in FIG. 18, an endless belt 200 runs in a direction of an arrow e being tightly stretched round plural rolls 101, 102 and 103, an image (toner image) formed on a photosensitive drum or the like by the electrophotographic system is once transferred onto, and carried by, the surface of the endless belt 200, and is transferred again onto a recording sheet such as recording paper which is conveyed so as to meet the belt 200, so that the belt running device works as a so-called intermediate transfer belt mechanism.

It has further been known to use the above belt running device as a photosensitive belt mechanism in which an electrostatic latent image corresponding to the image data and the toner image thereof are formed on the surface of an endless belt by the eletrophotographic system, or as a sheet conveyer/transfer belt mechanism in which a recording sheet onto which the image will be finally transferred is held by being adsorbed by the surface of the endless belt and is conveyed to a transfer position of a photosensitive material drum or the like on which the image is formed, and the recording sheet onto which the image is transferred from the photosensitive material drum or the like is discharged.

In the image-forming apparatus which utilizes the above belt running device, however, there occurs a zigzag phenomenon in which an endless belt 200 runs being shifted in the axial direction of the rolls (corresponds to the direction of width of the belt) or the endless belt 200 runs in a tilted manner being deviated from the direction at right angles with the rolls 101, 102 and 103, due to error in the production of belt and rolls for supporting the endless belt, error in the parallelism of rolls, and difference in the tension given to the belt at an end and the other end of each of the rolls. Thus, there often occurs a twisting phenomenon in which the endless belt 200 as a whole runs in a state of being twisted like a "figure 8" as shown in FIG. 19. When the endless belt runs in a state where the zigzag phenomenon or the twisting phenomenon is occurring, the image is not transferred onto a normal position on the endless belt or on the recording sheet in the case of the zigzag phenomenon. Or, in the case of the twisting phenomenon, a distorted image is transferred from the photosensitive drum onto the endless belt which is the intermediate transfer belt, or the image transferred again onto the recording sheet after once transferred onto the endless belt is skewed to a large extent. The above problems induce a new problem in that the image quality becomes defective due to deviation in the colors, color shade and the like in the color image formed by overlapping toner images of plural colors.

In order to solve such problems, the present applicant has proposed an image-forming apparatus (Japanese Patent Laid-Open No. 260590/1998, etc.) which is so constituted that, when the endless belt is running in a zigzag manner or in a twisted manner, an end of the drive roll for supporting and running the endless belt is displaced upward or downward, or an end of a back-up roll supporting the endless belt at a secondary transfer position where the image is transferred onto the recording sheet is displaced upward or downward by using an eccentric cam mechanism or the like, in order to incline the roll as a whole.

However, when one of the rolls supporting the endless belt is so displaced as to be inclined upward or downward, the tension of the endless belt undergoes a change, resulting in the occurrence of a problem that the belt is twisted due to a change in the tension. Here, the change in the tension is as shown in FIG. 18*b*; i.e., when an end of the roll 101 is inclined upward (white arrow) Yu, the tension applied to the endless belt portion 200*a* on the side inclined upward becomes larger than that of normal condition and, conversely, when the end of the roll 101 is inclined downward (hatched arrow) Yd, the tension applied to the endless belt portion 200*a* on the side inclined downward becomes smaller than that of normal condition. This problem may similarly occur even in the image-forming apparatus proposed by the present applicant in the Japanese Laid-Open Patent Application No. 2000-075680.

SUMMARY OF THE INVENTION

The present invention provides an image-forming apparatus which, when the running state of the belt is to be adjusted by displacing one of the rolls supporting the endless belt, prevents a twist in the belt that stems from a change in the tension of the endless belt accompanying a displacement of the roll.

The image-forming apparatus of the invention is for forming an image depending on the image data, and includes plural rolls supported so as to freely rotate, an endless belt that runs being tightly stretched round the plural rolls, a belt running adjusting mechanism that adjusts the running state of the endless belt by displacing at least an end of one roll, anda tension correction mechanism that corrects a change in the tension of the endless belt that stems from the operation of the belt running adjusting mechanism for displacing the roll, by displacing a contact member that is in contact with the belt along the direction of width thereof.

In this image-forming apparatus, when the roll is displaced by the belt running adjusting mechanism, the contact member of the tension correction mechanism displaces in a desired direction thereby to correct (cancel) a change in the tension of the endless belt that stems from the displacement of the roll. That is, the tension correction mechanism displaces the contact member in a direction in which the tension decreases when the tension is increased by the operation for displacing the roll, and displaces the contact member in a direction in which the tension increases when the tension is decreased by the operation for displacing the roll.

Any contact member can be used without imitation for the tension correction mechanism provided it is capable of correcting a change in the tension of the belt upon coming in contact with the belt in the direction of width thereof and undergoing the displacement. It is allowable to add a new contact member. Desirably, however, the existing part may be utilized. The existing part may be at least a roll among plural rolls supporting the endless belt and other than the roll displaced by the belt running adjusting mechanism, or may be a blade brought into pressed contact with the endless belt. When the contact member is the roll, an end of the roll may be displaced in a predetermined direction to correct a change in the tension of the belt. When the contact member is the blade, the pressure with which the blade comes into contact with the surface of the belt may be so displaced that the tension of the belt changes to assume a desired state. A cleaning blade may be used as the blade.

The tension correction mechanism may be so controlled as to operate after having detected a change (or a twist) in the tension of the endless belt following the operation for displacing the roll by the belt running adjusting mechanism. Desirably, however, the tension correction mechanism should be controlled to operate being interlocked to the displacing operation of the belt running adjusting mechanism. In this case, it is allowed to increase the range of adjusting the belt running state by the belt running adjusting mechanism and to increase the speed of adjustment in addition to quickly coping with a change in the tension of the belt.

The endless belt may be a photosensitive belt used in the photoelectronic system, or a sheet conveyer/transfer belt for adsorbing and conveying a recording sheet up to a position for transferring the image, in addition to the intermediate transfer belt. The image-forming apparatus including both the belt running adjusting mechanism and the tension correction mechanism, can be applied to a color image-forming apparatus of the type which forms a color image by transferring and overlapping toner images of plural colors one by one, suppressing the above-mentioned problem of color deviation or color shading.

BRIEF DESCRIPTION OF THE DRAWINGS

Preferred embodiments of the present invention will be described in detail with reference to the accompanying figures, wherein.

DESCRIPTION OF THE PREFERRED EMBODIMENTS

Embodiment 1

Figure 1:
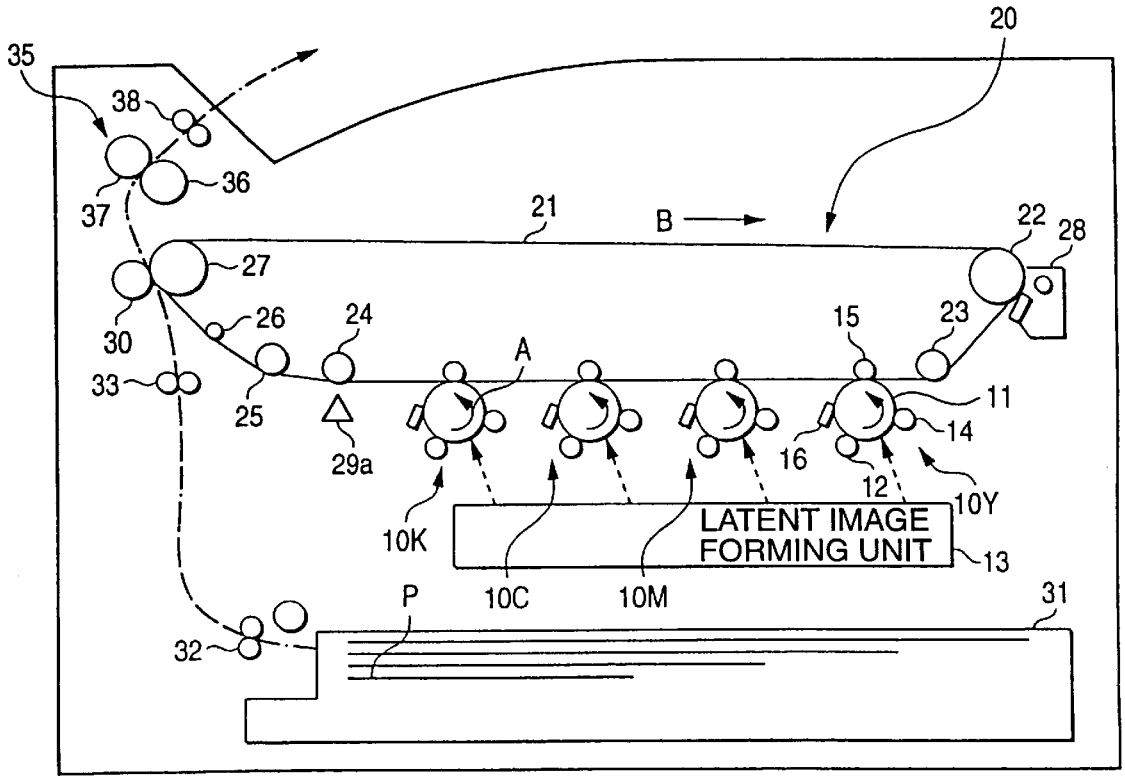
FIG. 1 is a view schematically illustrating major portions of an image-forming apparatus according to an embodiment 1.
Figure 2:
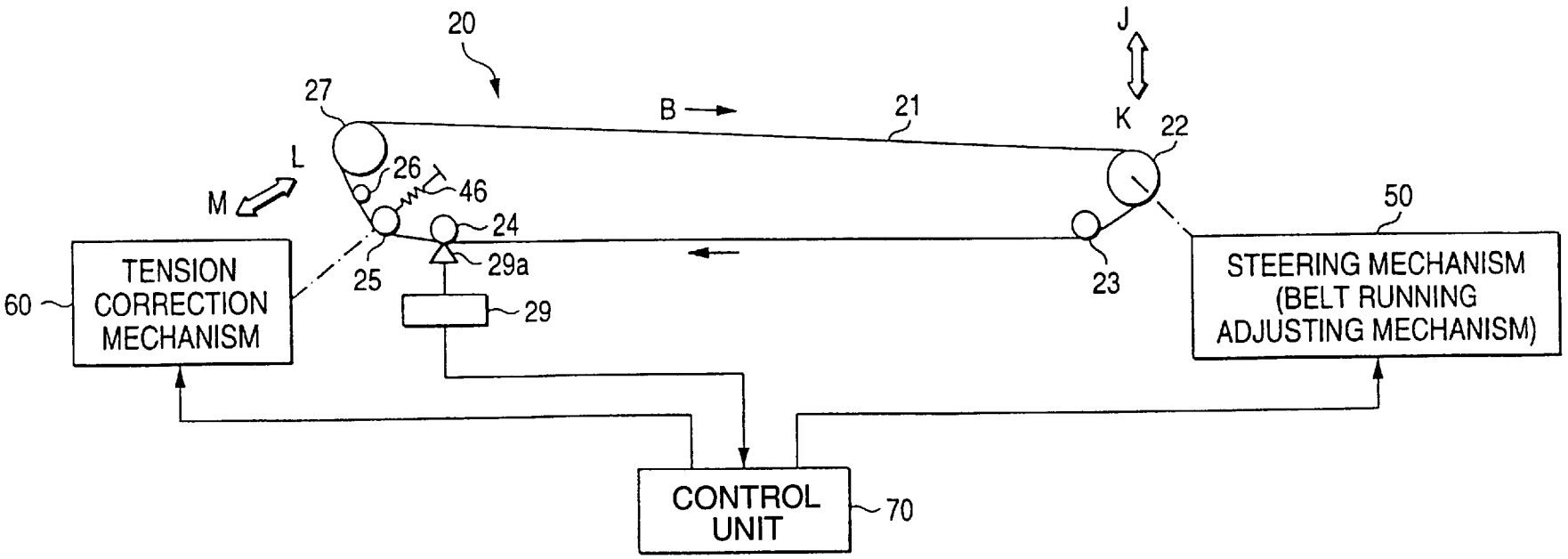
FIG. 2 is a view illustrating the constitution of an intermediate transfer belt mechanism according to the embodiment 1.

FIGS. 1 and 2 illustrate an embodiment 1 of the present invention, and wherein FIG. 1 is a view schematically illustrating the entire constitution of an image-forming apparatus according to the embodiment 1, and FIG. 2 is a view illustrating an intermediate transfer belt mechanism employed by the image-forming apparatus.

The image-forming apparatus of the embodiment 1 is a color image-forming apparatus in which toner images of four colors, i.e., yellow (Y), magenta (M), cyan (C) and black (k) separately formed by four image-forming units 10Y, 10M, 10C and 10K, are primarily transferred so as to be superposed on the surface of an intermediate transfer belt 21 of an intermediate transfer belt mechanism 20, and are secondarily transferred from the intermediate transfer belt 21 onto a recording sheet P thereby to form a so-called full-color image. Further, this apparatus is capable of forming a black-and-white image by operating the image-forming unit 10K for black only among the four image-forming units.

The image-forming units 10 are for forming a toner image by an electrophotographic process and basically include a photosensitive drum 11, a charger (charging roll) 12, a latent image-forming unit 13, a developer 14, a transfer unit (transfer roll) 15 and a drum cleaner 16, respectively. In each image-forming unit 10, the photosensitive drum 11 rotating in the direction of an arrow A is uniformly charged by the charger 12, the electrically charged surface is scanned by a laser beam (dotted arrow) depending upon the image data obtained by decomposing the colors by the latent image-forming device 13 thereby to write electrostatic latent image which is then developed into a toner image with a developing agent supplied from the developer 14. Finally, the toner image is electrostatically and primarily transferred onto the surface of the intermediate transfer belt 21 that passes through between the photosensitive drum 11 and the transfer unit 15. The surface of the photosensitive drum 11 after transferred is cleaned by a blade of the drum cleaner 16.

In the intermediate transfer belt mechanism 20, the intermediate transfer belt 21 which is an endless belt is tightly stretched round a drive roll 22, an idle roll 23, a driven roll 24, a tension roll 25, a pulley roll 26 and a back-up roll 27, and runs in the direction of an arrow B due to the rotational force of the drive roll 22. The rolls are rotatably supported by bearings. In FIG. 1, reference numeral 28 denotes a cleaner for the intermediate transfer belt, 29 denotes a detector for detecting the presence of a belt home mark formed on a side end of the intermediate transfer belt and for detecting the position of a belt edge (edge portion), and 29*a* denotes a sensor unit thereof.

The toner image transferred in a multiplexed manner onto the intermediate transfer belt 21 of the intermediate transfer belt mechanism 20 is conveyed up to the secondary transfer position opposing a secondary transfer roll 30 which is disposed being opposed to the back-up roll 27. The toner image on the intermediate transfer belt 21 is electrostatically and secondarily transferred onto the recording sheet P delivered from a container tray 31 and is conveyed to the secondary transfer position through a sheet conveyer passage along which rolls 32, resist rolls 33 and the like are arranged, in synchronism with the formation of the toner image and the transfer timing. In FIG. 1, a dot-dash chain line represents a conveyer passage of the recording sheet. The recording sheet P onto which the toner image is transferred, is conveyed to pass through a nipping portion between a heating roll 36 and a pressing roll 37 in a roll-nip type fixing unit 35, so that the toner image is thermally fixed, and the recording sheet P is then discharged by discharge rolls 38 out of the apparatus. A color image is formed on the recording sheet P through the above-mentioned process.

The intermediate transfer belt mechanism 20 of this embodiment is provided, as shown in FIG. 2, with a belt running adjusting mechanism (hereinafter also referred to as "steering mechanism") for adjusting the running state of the intermediate transfer belt 21 by displacing an end of the drive roll 22 in the predetermined adjusting directions J, K, and with a tension correction mechanism 60 for correcting a change in the tension of the intermediate transfer belt 21 that stems from the operation of the belt running adjusting mechanism 50 for displacing the drive roll 22 by displacing an end of the tension roll 25 along the predetermined correction directions L, M.

Figure 3A:
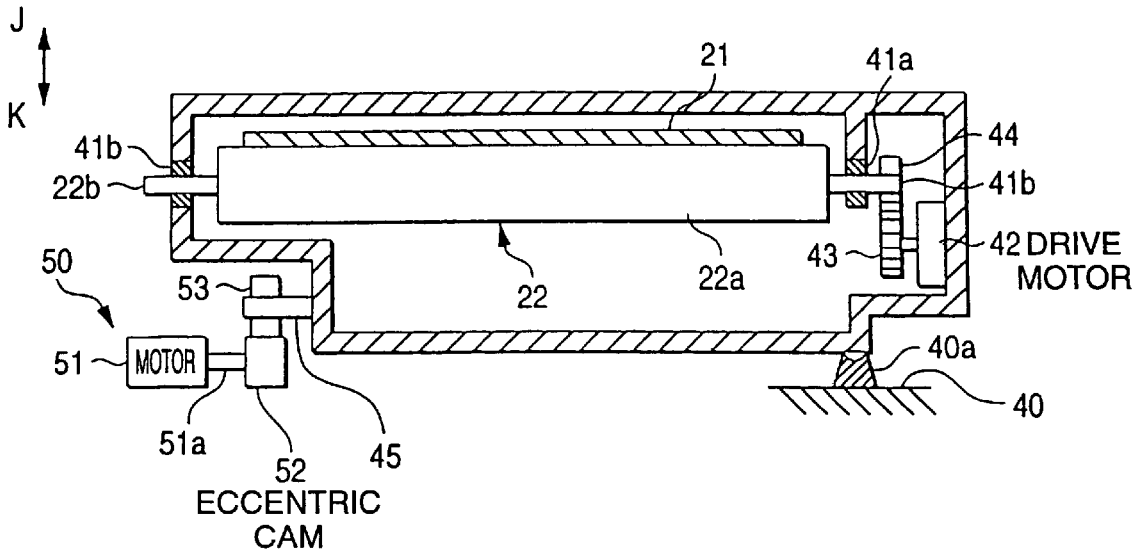
FIG. 3A is a view illustrating, partly in cross section, the constitution of a drive roll and a steering mechanism.
Figure 3B:
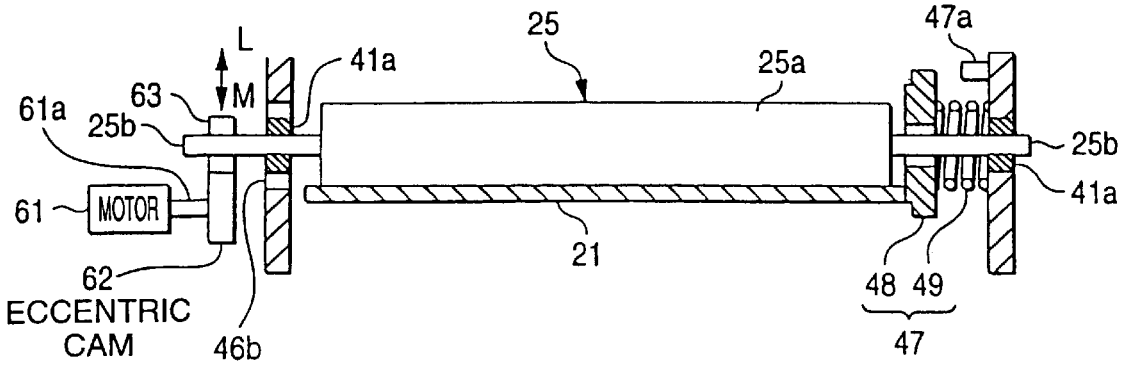
FIG. 3B is a view illustrating, partly in cross section, the constitution of a tension roll and of a tension correction mechanism.

FIGS. 3A and 3B illustrate a drive roll 22 provided with the steering mechanism 50 and a tension roll 25 provided with the tension correction unit 60.

In the drive roll 22, a roll shaft 22*b* secured to a roll body 22*a* is rotatably supported by a drive roll unit housing 41 via bearings 41*a*, 41*b*. The drive roll unit housing 41 is supported by shaft at its lower position at an end in the direction of the roll shaft by a bracket 40*a* that swings relative to a fixed frame 40, and is supported at its other end portion by the steering mechanism 50 that will be described later. The drive roll 22 rotates as it receives the rotational force of a drive motor 42 through a gear train of a drive gear 43 attached to the output shaft of the drive motor 42 and a driven gear 44 attached to the roll shaft 22*b* in mesh therewith. The rotational speed of the drive roll 22 is detected by a rotational speed detector mechanism such as rotary encoder, that is not shown, attached to the roll shaft 22*b*. The drive motor 42 stably rotates as its rotational state is controlled by feed back based on the detected data.

Figure 3C:
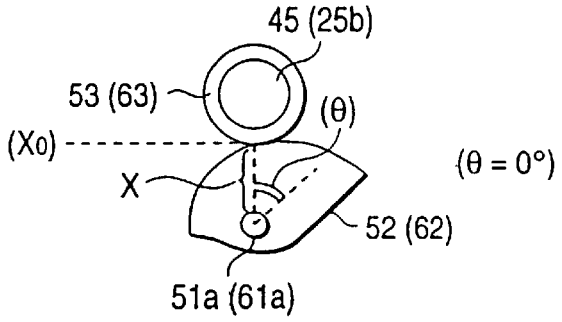
FIG. 3C is a view illustrating major portions of the steering mechanism and of the tension correction mechanism.
Figure 4:
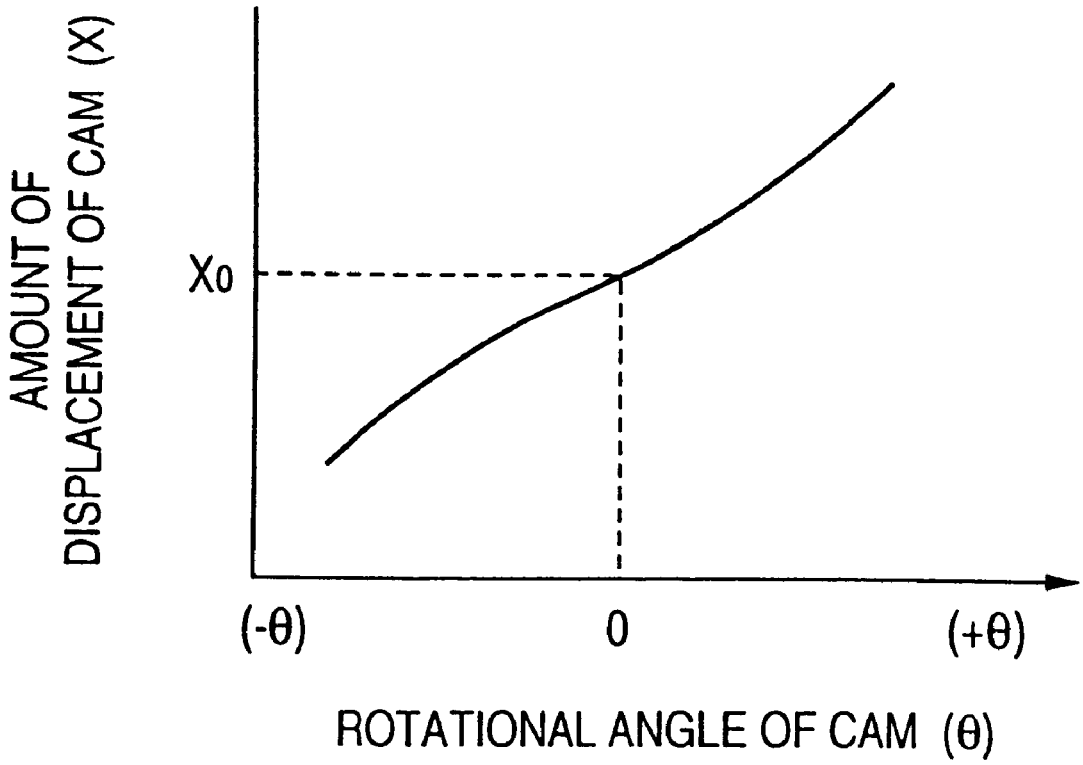
FIG. 4 is a graph showing a relationship between the rotational angle of an eccentric cam in the steering mechanism and in the tension correction mechanism and the amount of displacement thereof.

The steering mechanism 50 provided for the drive roll 22 (strictly, drive roll unit housing 41) includes a motor 51 for steering such as stepping motor, an eccentric cam 52 attached to the output shaft 51*a* of the motor 51, and a cam follower 53 attached to a support shaft 45 protruding in the axial direction from the side surface of the unit housing 41 so as to come in contact with the eccentric cam 52. As the eccentric cam 52 is rotated by the driving force of the steering motor 51 by an angle θ in the direction from a reference position $X_0$ (=0°) (FIG. 3*c*), as shown in FIG. 4, the cam is displaced by a predetermined amount and, hence, the drive roll unit housing 41 is displaced or the drive roll 22 is displaced by a distance corresponding to the amount of displacement of the cam in the adjusting directions J, K. In this embodiment, the adjusting directions J, K in which the drive roll 22 is displaced is set to the up-and-down direction of the apparatus. Concretely speaking, the adjusting direction J is the "upper direction" and the adjusting direction K is the "lower direction".

The tension roll 25 is supported by a conventional tension-imparting mechanism 46 in a manner to impart a predetermined tension to the intermediate transfer belt 21 from the back surface side thereof, and wherein an end of the roll shaft 25*b* to which the roll body 25*a* is secured is supported by a ball bearing 41*a* so as to rotate and is allowed to be inclined relative to a support frame 46*a* of the tension-imparting mechanism 46, and the other end of the roll shaft 25*b* is rotatably supported by a bearing 41*a* so as to move up and down along an elongated hole 46*b* formed in the support frame 46*a* via the bearing 41*a*. The tension roll 25 includes a belt end restriction mechanism 47 for restricting the zigzag running of the intermediate transfer belt 21. The belt end restriction mechanism 47 is constituted by a restriction plate 48 of the shape of a doughnut disk loosely fitted to the roll shaft 45*b* to restrict the end portion as the belt end comes in contact therewith, and a spring 49 which is secured at its one end to the restriction plate 48 and is secured at its other end to the support fame 46*a* so that the restriction plate 48 is supported in a manner that it is allowed to be easily and resiliently displaced in the axial direction of the roll shaft 45*b*. Reference numeral 47*a* denotes a stopper for stopping the restriction plate 48 at a maximum motion permitted position.

The tension correction unit 60 provided for the tension roll 25 is basically constituted in the same manner as the steering mechanism 50, and includes a tension correction motor 61 such as stepping motor, etc., an eccentric cam 62 attached to the output shaft 61*a* of the motor 61, and a cam follower 63 attached to the roll shaft 25*b* so as to come in contact with the eccentric cam 62. Nearly like in the case of the steering mechanism 50, as the eccentric cam 62 rotates by an angle θ in the direction from the reference position $X_0$ (=0°) (FIG. 3*c*), the cam is displaced by a predetermined amount as shown in FIG. 4, and the roll shaft 25*b* or the tension roll 25 is displaced in the correction directions L, M by a distance corresponding to the amount of displacement of the cam. In this embodiment, the correction directions L, M in which the tension roll 25 is displaced are the directions in which the tension imparted to the intermediate transfer belt 21 can be easily increased or decreased. Concretely speaking, the correction directions are opposite to the directions of the tension imparting mechanism 46, and the correction direction L is the "direction in which the tension decreases" and the correction direction M is the "direction in which the tension increases".

Referring to FIG. 2, the steering mechanism 50 and the tension correction unit 60 in the intermediate transfer belt mechanism 20 are connected to a control unit 70 which controls the operations. Basically, the control unit 70 operates the walking (zigzag) amount of the belt 21 from the home mark detection data and the belt edge detection data of the intermediate transfer belt 21 obtained by the detector 29, finds the steering amount (angle $\alpha$) of the steering mechanism 50 from the walking amount, finds a tension correction angle $\beta$ for the tension correction unit 60, and operates the motors 51, 61 depending upon the steering angle $\alpha$ and the tension correction angle $\beta$. The detector 29 is constituted by an optical sensor, CCD or the like capable of detecting a belt home mark or a belt edge position. The control unit is constituted by a ROM storing various control programs and the like, a RAM fetching and storing detected data and the like, or a CPU for executing the operation based on the control program and the detected data.

Figure 5:
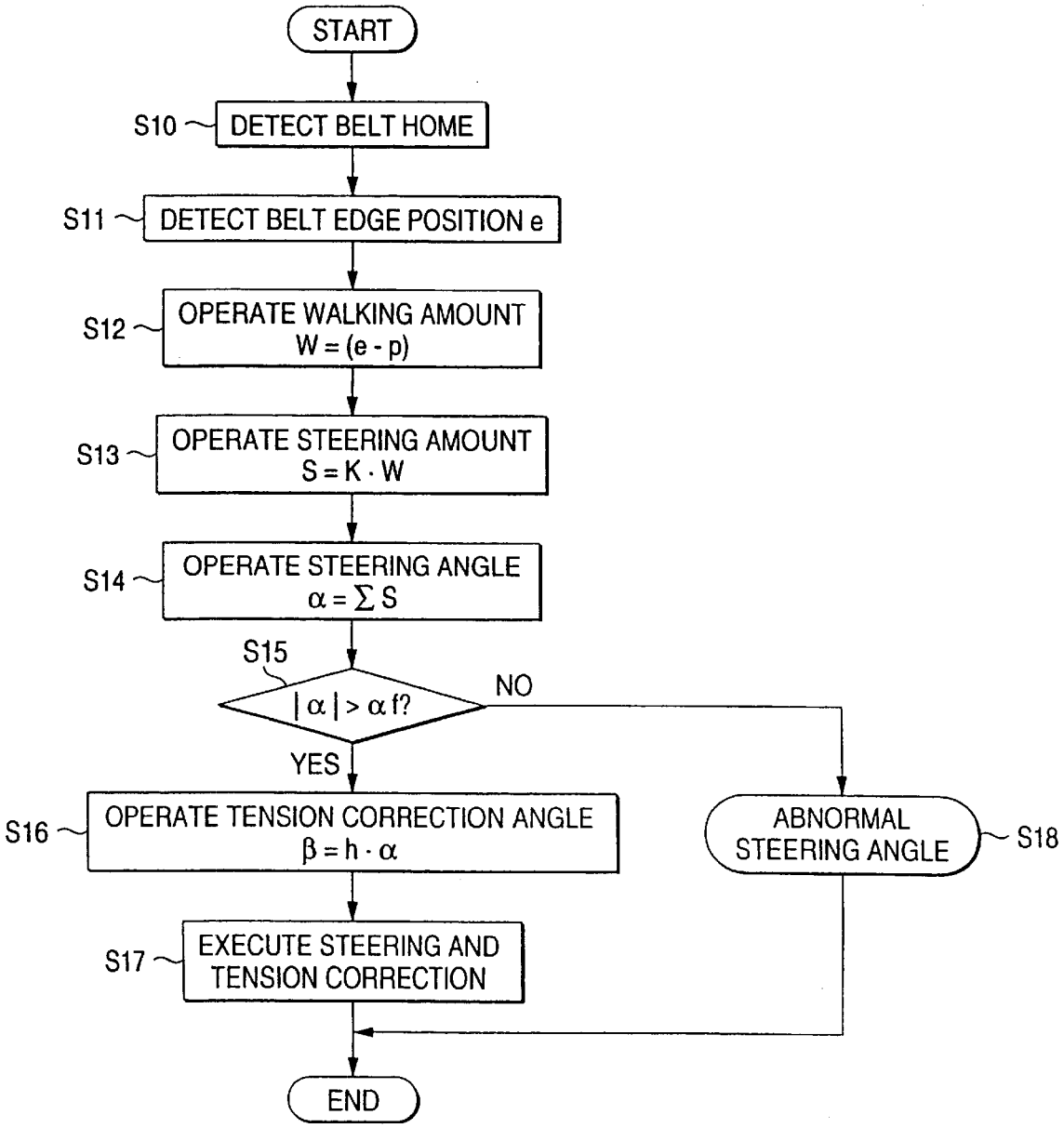
FIG. 5 is a flowchart illustrating a procedure of operation of the steering mechanism and of the tension correction mechanism.

Next, described below are the operations of the steering mechanism 50 and of the tension correction unit 60 in the intermediate transfer belt mechanism 20. FIG. 5 is a flowchart illustrating a procedure of control operations.

Figure 6:
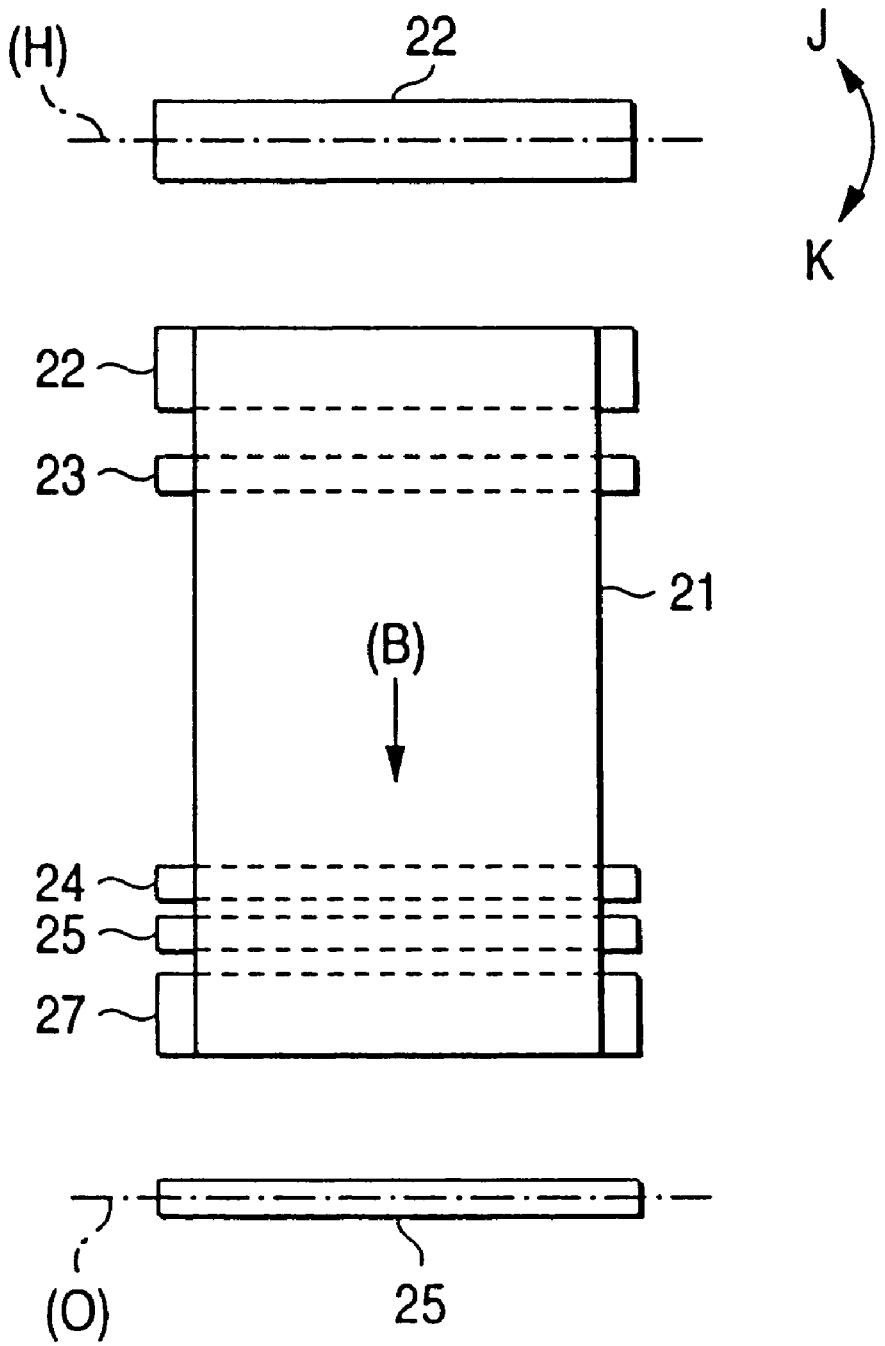
FIG. 6 is a view illustrating a state of the intermediate transfer belt mechanism under ordinary condition.

Under normal condition as shown in FIG. 6, the drive roll 22 and the tension roll 25 are such that the roll shaft of the drive roll 22 is in parallel with a horizontal reference line (dot-dash chain line) H and the roll shaft of the tension roll 25 is in parallel with a central reference line (dot-dash chain line) O.

When the intermediate transfer belt mechanism 20 receives an instruction for starting the operation, the drive roll 22 starts rotating and the intermediate transfer belt 21 starts running in the direction of an arrow B. Here, a belt home mark formed on a side end portion of the intermediate transfer belt 21 is detected by the detector 29 (step 10, hereinafter abbreviated like "S10") and, then, a belt edge position e is detected (S11). The control unit 70 operates the walking amount W (=e−p) of the intermediate transfer belt 21 based on the detected data (particularly, data of detecting the edge position)(S12), and operates the steering amount S (=k·W) of the steering mechanism 50 to operate the steering angle $\alpha$ (=ΣS) (S13, S14). The angle $\alpha$ is found as an elevation angle with respect to the horizontal reference line H mentioned above. The angle on the side of the adjusting direction J in excess of the reference line H is operated as a plus angle "+$\alpha$" and the angle on the side of the adjusting direction K in excess of the reference line H is operated as a minus angle "−$\alpha$". Symbol p denotes an initial position of the belt edge, and k denotes a coefficient for conversion that has been found in advance through experiment. In this image-forming apparatus, it is judged whether the steering angle $\alpha$ (absolute value thereof) that is operated is smaller than a threshold value $\alpha$f of the angle that has been set in advance (S15). When the steering angle $\alpha$ is not smaller than the threshold value f, it is so regarded that the "steering angle is abnormal" (S18), and the operation of the belt running mechanism 20 is stopped.

Next, as the steering angle $\alpha$ is found, the control unit 70 operates the tension correction angle $\beta$ (=h·$\alpha$) for the tension correction unit 60 (S16). The correction angle $\beta$ is found as an elevation angle with respect to the central reference line O described above, and the angle on the side of the correction direction L in excess of the reference line O is operated as a plus angle "+$\beta$" and an angle on the side of the correction direction M in excess of the reference line O is operated as a minus angle "−$\beta$". Symbol h denotes a coefficient for conversion that has been found in advance through experiment.

Thus, as the steering angle a and the tension correction angle $\beta$ are operated, the control unit 70 produces an instruction for controlling the execution of operations to the steering mechanism 50 and to the tension correction mechanism 60, whereby the motors 51 and 61 rotate simultaneously by predetermined angles in the predetermined directions (S17). As a result, the eccentric cams 52 and 62 rotate, and the drive roll 22 and the tension roll 25 are inclined by predetermined angles $\alpha$, $\beta$, with respect to the horizontal reference line O.

FIG. 7 illustrates a behavior of the intermediate transfer belt 21 of when the drive roll 22 is inclined by the steering mechanism 50 by a steering angle $\alpha$ (the tension roll 25 is remaining in a horizontal state without inclined).

Figure 7A:
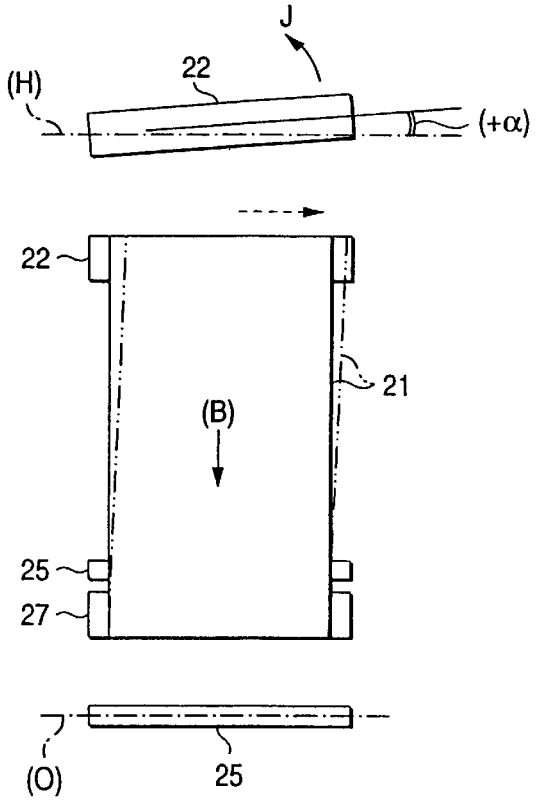
FIGS. 7A and 7B are views illustrating a state of the intermediate transfer belt mechanism when the steering mechanism is in operation.
Figure 7B:
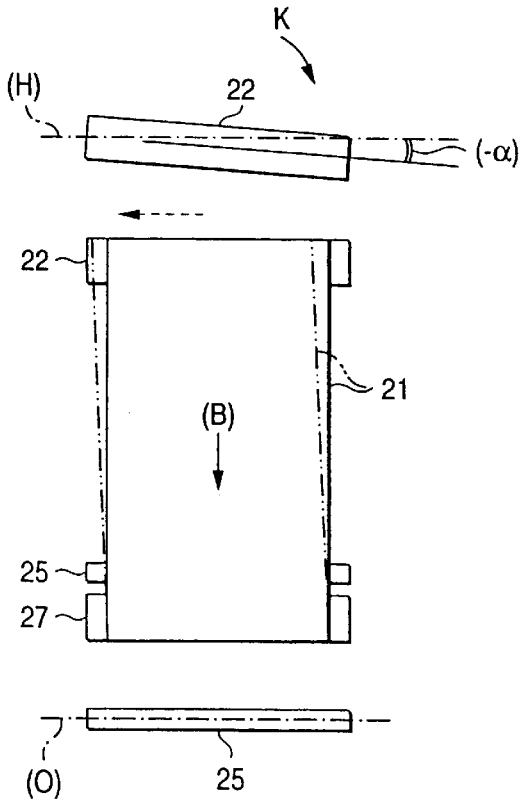

Referring, first, to FIG. 7A, when the drive roll 22 is inclined by a steering angle +$\alpha$ and is displaced in the adjusting direction J, the intermediate transfer belt 21 runs being displaced toward an end of the drive roll 22 that is displaced in the adjusting direction J from the horizontal reference position H as indicated by two-dot chain line in the drawing. Referring to FIG. 7B, conversely, when the drive roll 22 is inclined by a steering angle −$\alpha$ and is displaced in the adjusting direction K, the intermediate transfer belt 21 runs being displaced toward an end (at a position which is relatively high) on the side opposite to the end of the drive roll 22 displaced in the adjusting direction K from the horizontal reference position H as indicated by a two-dot chain line in the drawing. When the drive roll 22 is displaced by the steering mechanism 50 in the adjusting direction J or K, the intermediate transfer belt 21 as a whole runs being completely shifted in the direction of the roll shaft 22*b* thereof by an amount corresponding to the inclination of the drive roll 22 in either direction at a moment when a portion of the intermediate transfer belt 21 passing over the drive roll 22 when it is displaced has rotated one turn and passes again on the drive roll 22. Therefore, the running state of the belt is adjusted by the steering mechanism 50 requiring a time for the belt to rotate one turn.

Here, when the drive roll 22 is inclined by the steering mechanism 50 by a steering angle $\alpha$ in the adjusting direction J which is the upper direction, the tension of the intermediate transfer belt 21 becomes larger than that of during the normal operation on a portion where the drive roll 22 is inclined. As a result, the belt 21 as a whole loses a balance in the tension and may often be twisted. Further, when the drive roll 22 is displaced in the adjusting direction K which is the lower direction, the tension of the intermediate transfer belt 21 becomes smaller than that of during the normal operation on a portion where the drive roll 22 is inclined. As a result, the belt 21 as a whole loses a balance in the tension and may often be twisted.

In this image-forming apparatus, therefore, the tension correction mechanism 60 is operated being interlocked to the operation of the steering mechanism 50 for displacing the drive roll 22, so that the tension roll 25 is displaced in the predetermined correction directions L and M, thereby to correct the change in the belt tension.

Figure 8:
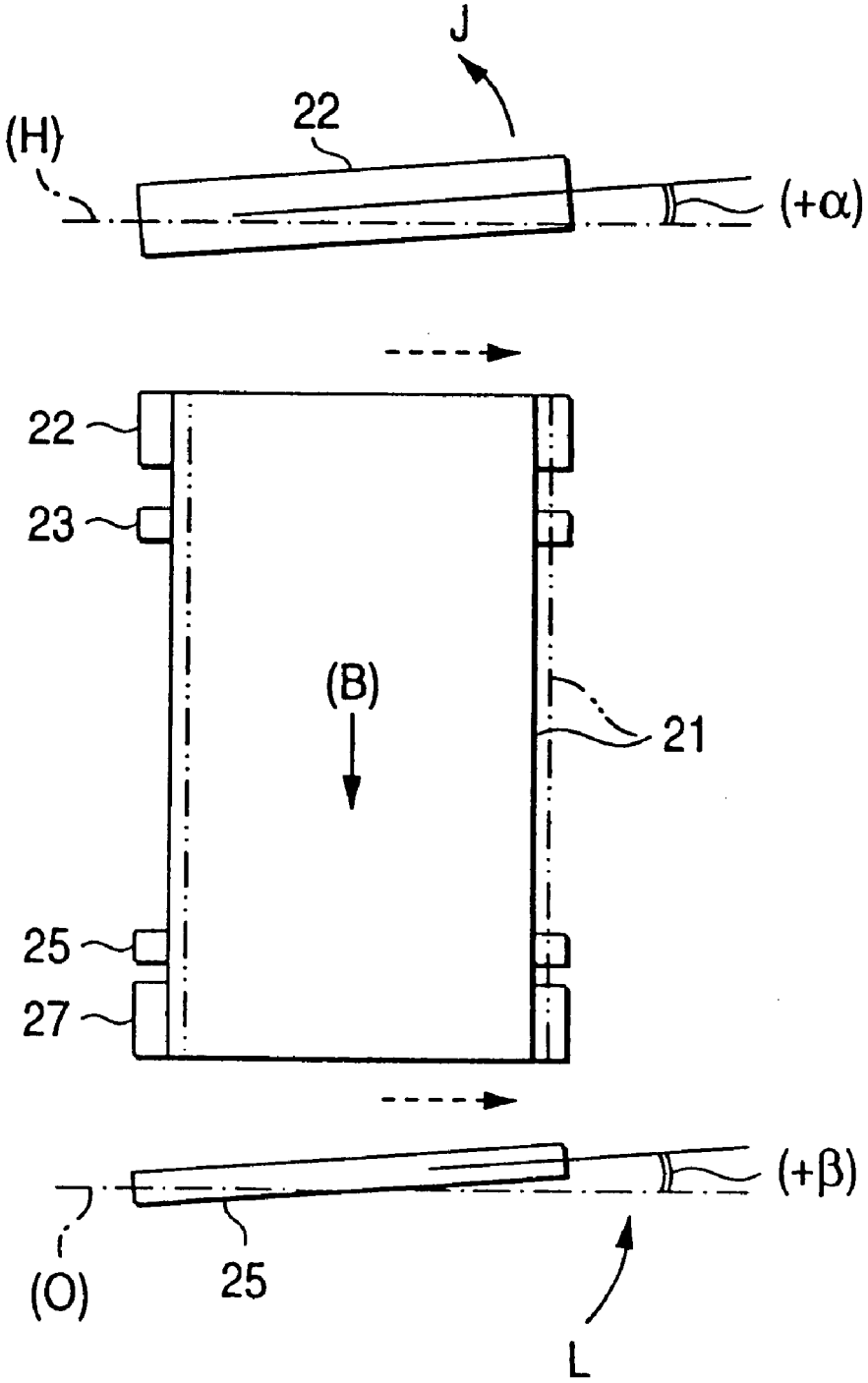
FIG. 8 is a view illustrating a state of the intermediate transfer belt mechanism when the steering mechanism is in operation (tension is increasing) and the tension correction mechanism is in operation.
Figure 9:
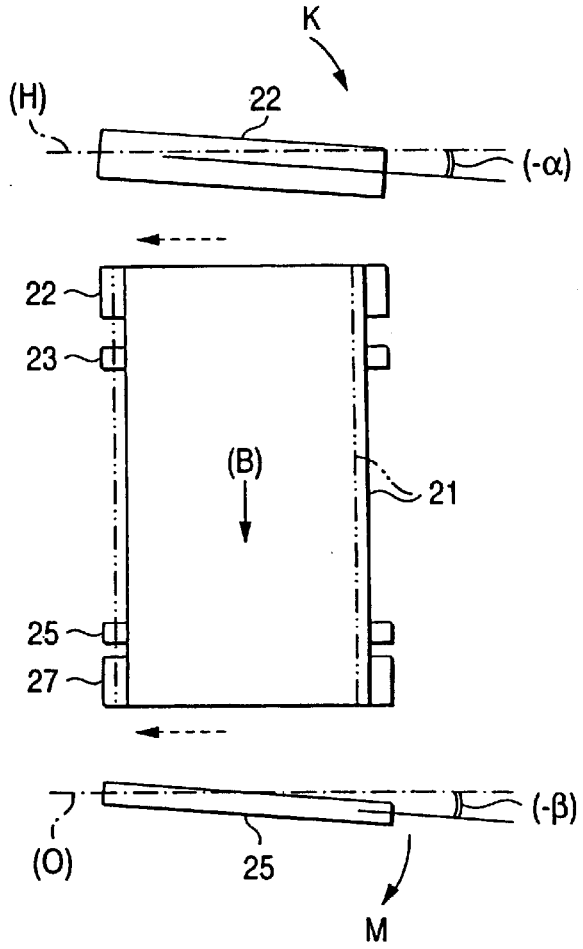
FIG. 9 is a view illustrating a state of the intermediate transfer belt mechanism when the steering mechanism is in operation (tension is decreasing) and the tension correction mechanism is in operation.

FIGS. 8 and 9 illustrate a behavior of the intermediate transfer belt 21 of when the tension roll 25 is inclined by the tension correction mechanism 60 by a correction angle $\beta$ (being interlocked to the operation of the steering mechanism 50 for displacing the drive roll 22).

That is, when the drive roll 22 is displaced in the adjusting direction J as shown in FIG. 8, the tension roll 25 is inclined by a correction angle +$\beta$ and is displaced in the correction direction L. Then, the intermediate transfer belt 21 runs being displaced toward an end of the drive roll 22 that is displaced in the adjusting direction J from the horizontal reference position H as indicated by a two-dot chain line in the drawing and, at the same time, runs being displaced toward an end of the tension roll 25 that is displaced in the correction direction L from the central reference position O to decrease the belt tension. As a result, the tension of the intermediate transfer belt 21 increases on the side of the drive roll 22 that is displaced in the adjusting direction J. Here, however, a change in the tension is canceled by the tension roll 25 that is displaced in the correction direction L in which the tension decreases, and the intermediate transfer belt 21 is not twisted.

On the other hand, when the drive roll 22 is displaced in the adjusting direction K as shown in FIG. 9, the tension roll 25 is inclined by a correction angle $-\beta$ and is displaced in the correction direction M. Then, the intermediate transfer belt 21 runs being displaced toward an end opposite to the end of the drive roll 22 displaced in the adjusting direction K from the horizontal reference position H as indicated by a two-dot chain line in the drawing and, at the same time, runs being displaced in the correction direction M from the central reference position O to increase the belt tension. As a result, the tension of the intermediate transfer belt 21 decreases on the side of the displaced drive roll 22 that is displaced in the adjusting direction K. However, a change in the tension is canceled by the tension roll 25 that is displaced in the correction direction M in which the tension increases, and the intermediate transfer belt 21 is not twisted.

Figure 10:
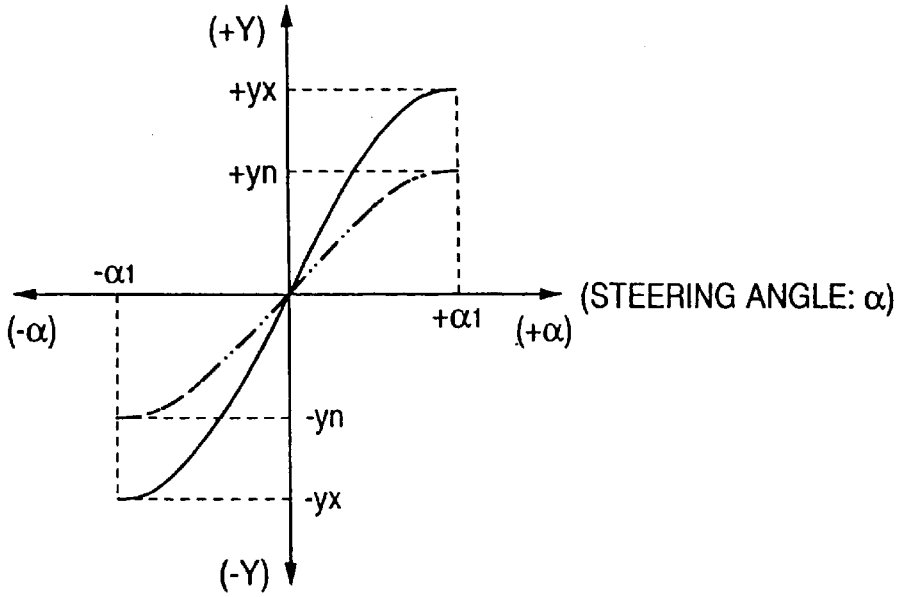
FIG. 10 is a graph showing a relationship between the steering angle and the amount of displacement of the belt.

According to the study conducted by the present inventors, further, the tension correction mechanism 60 is operated being interlocked to the operation of the steering mechanism 50 for displacing the drive roll 22 in the image-forming apparatus, whereby the amount Y of displacement of the intermediate transfer belt 21 relative to the direction of the roll shaft becomes larger (solid line in FIG. 10 than that of when the drive roll 22 only is displaced by the steering mechanism 50 by a steering angle $\alpha$ (two-dot chain line). That is, the range for adjusting the belt running condition by the steering mechanism 50 can be broadened with respect to the same steering angle $\alpha$. This is presumably due to that the tension roll 25 displaced by the tension correction mechanism 60 promotes the operation of the steering mechanism 50 for displacing the intermediate transfer belt 21.

Figure 11:
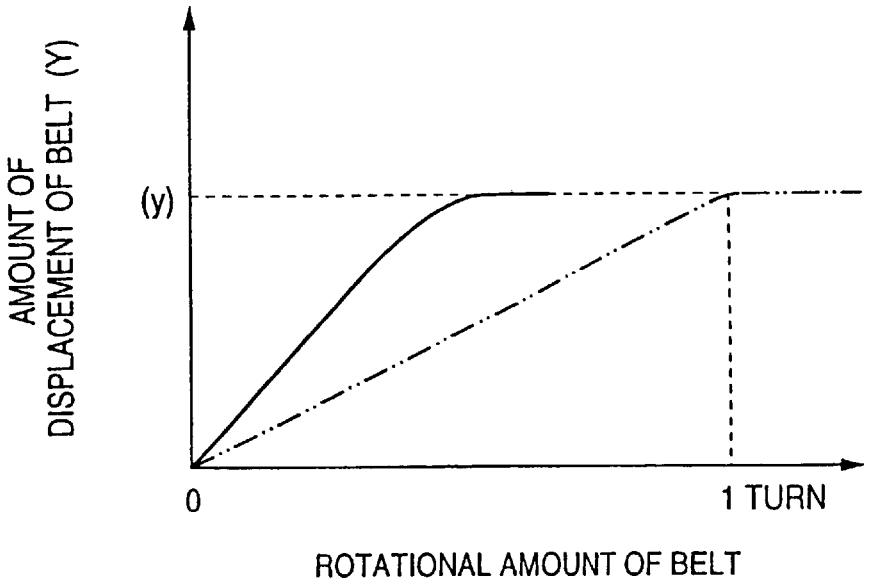
FIG. 11 is a graph showing a relationship between the rotational amount of the belt and the amount of displacement of the belt when displaced by the same steering angle.

In the image-forming apparatus, further, when viewed from the displacement relative to the amount of rotation of the belt, the amount of displacement Y of the intermediate transfer belt 21 relative to the direction of the roll shaft is accomplished within a short period of time (solid line) compared to when the drive roll 22 only is displaced by the steering mechanism 50 by the steering angle $\alpha$ (two-dot chain line) as shown in FIG. 11. That is, when the steering mechanism 50 only is operated, the belt must be rotated one turn for being displaced. When the tension correction mechanism 60 is operated being linked to the steering mechanism 50, however, the belt is shifted before rotating one turn. This makes it possible to increase the speed of adjusting the belt running state by the steering mechanism 50 for the same steering angle $\alpha$. This is also presumed that the tension roll 25 displaced by the tension correction mechanism 60 works to promote the operation of the steering mechanism 50 for displacing the intermediate transfer belt 21.

According to the image-forming apparatus of the embodiment 1, the intermediate transfer belt 21 that may happen to run in a zigzag manner or being deviated to one side of the rolls, is adjusted for its running state by the operation of the steering mechanism 50 to run in a normal state. Besides, the tension correction mechanism 60 operates being interlocked to the operation of the steering mechanism 50, correcting a change in the tension of the belt stemming from the operation of the steering mechanism 50 and preventing the belt from being twisted due to a change in the tension thereof. Therefore, the toner image formed by the image-forming units 10 is primarily transferred onto a correct transfer position on the intermediate transfer belt 21 and is, then, secondarily transferred onto a correct transfer position on the recording sheet P. Further, the toner image transferred from the image-forming units 10 to the intermediate transfer belt 21 is not distorted. Besides, the toner image transferred again from the intermediate transfer belt 21 onto the recording sheet P is not greatly skewed. Even in forming a full-color image, there occurs no defect in the picture quality such as color deviation or color shading, that stems from a defective running of the intermediate transfer belt 21.

Embodiment 2

Figure 12:
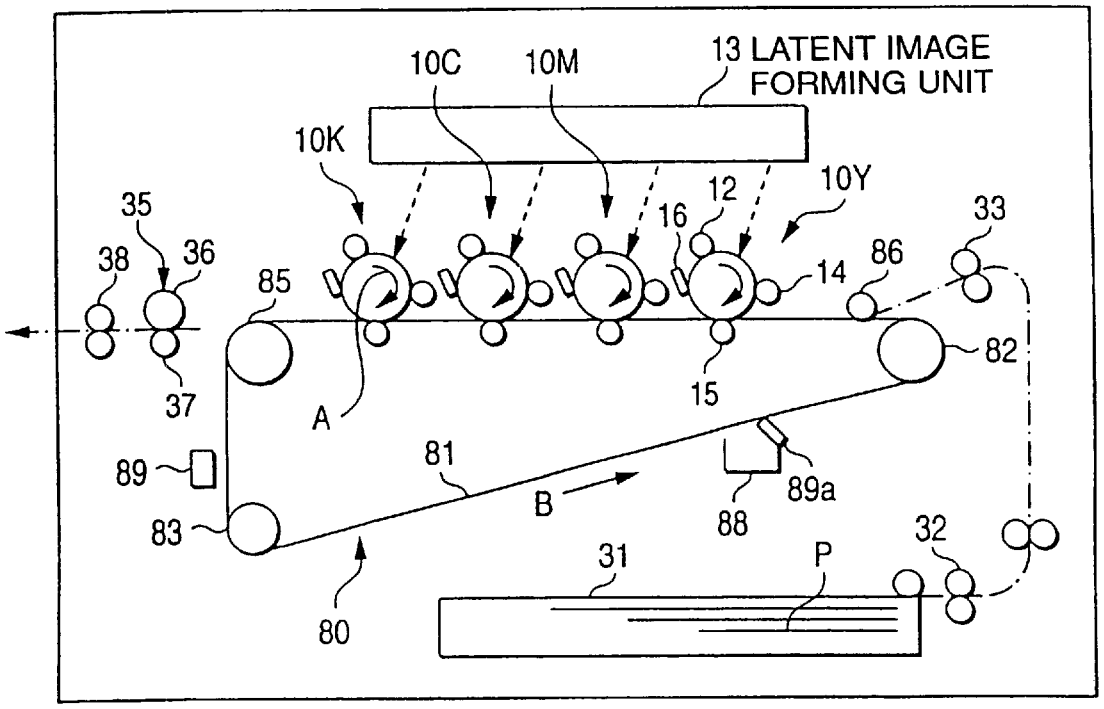
FIG. 12 is a view schematically illustrating major portions of the image-forming apparatus according to an embodiment 2.
Figure 13:
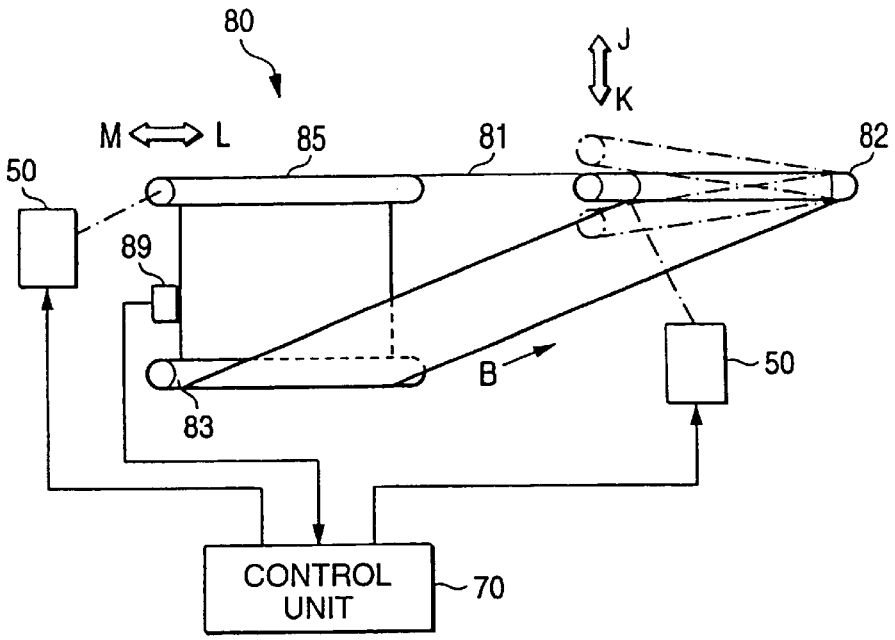
FIG. 13 is a view illustrating the constitution of a sheet conveyer/transfer belt mechanism according to the embodiment 2.

FIGS. 12 and 13 illustrate an embodiment 2 of the invention, wherein FIG. 12 is a view schematically illustrating the whole constitution of the image-forming apparatus according to the embodiment 2, and FIG. 13 is a view illustrating a sheet conveyer/transfer belt mechanism employed by the image-forming apparatus.

The image-forming apparatus of the embodiment 2 is constituted in the same manner as the image-forming apparatus of the embodiment 1 with the exception of using a sheet conveyer/transfer belt mechanism 80 instead of the intermediate transfer belt mechanism 20. That is, when a full-color image is to be formed by the image-forming apparatus, the toner images of four colors separately formed by the four image-forming units 10 are successively transferred in an overlapping manner onto the recording sheet P that is conveyed being adsorbed by the surface of a sheet conveyer/transfer belt 81 of the sheet conveyer/transfer belt mechanism 80, and the recording sheet P after transferred is peeled off the sheet conveyer/transfer belt 81 and is sent to a fixing unit 35.

In the sheet conveyer/transfer belt mechanism 80 employed in this embodiment, the sheet conveyer/transfer belt 81 which is an endless belt is tightly stretched round a drive roll 82, a driven roll 83 and a tension roll 85, and runs in the direction of an arrow B due to the rotational force of the drive roll 82. The rolls are rotatably supported by bearings. In FIG. 12, reference numeral 88 denotes a belt cleaner for the sheet conveyer/transfer belt 81, and 89 denotes a detector including a sensor unit for detecting the presence of a belt home mark formed on a side end of the sheet conveyer/transfer belt 81 and the position of the belt edge. Further, reference numeral 86 denotes a sheet adsorbing unit for causing the recording sheet P to be electrostatically adsorbed by the surface of the sheet conveyer/transfer belt 81.

Referring to FIG. 13, the sheet conveyer/transfer belt mechanism 80 is provided with a steering mechanism 50 for adjusting the running state of the sheet conveyer/transfer belt 81 by displacing an end of the drive roll 82 in the predetermined adjusting directions J, K, and with a tension correction mechanism 60 for correcting a change in the tension of the sheet conveyer/transfer belt 81 caused by the operation of the steering mechanism 50 for displacing the drive roll 82 by displacing an end of the tension roll 85 along the predetermined correction directions L, M nearly in the same manner as the intermediate transfer belt mechanism 20 of the embodiment 1.

The drive roll 82, steering mechanism 50, tension roll 85 and tension correction unit 60 in the sheet conveyer/transfer belt mechanism 80 are constituted nearly in the same manner as the drive roll 22, steering mechanism 50 therefor, tension roll 25 and tension correction unit 60 in the intermediate transfer belt mechanism 20 of the embodiment 1 (see FIGS. 2 to 4). As shown in FIG. 13, further, the steering mechanism 50 and the tension correction unit 60 in the belt mechanism 80 are connected to the control unit 70 like in the embodiment 1, and the operations are controlled by the control unit 70.

Next, described below are operations of the steering mechanism 50 and of the tension correction unit 60 in the sheet conveyer/transfer belt mechanism 80.

In this image-forming apparatus, the tension correction mechanism 60 operates being interlocked to the operation of the steering mechanism 50 for displacing the drive roll 82, so that the tension roll 85 is displaced in the predetermined correction directions L, M thereby to correct a change in the tension of the sheet conveyer/transfer belt 81 caused by the operation of the steering mechanism 50 for displacing the drive roll 82. Here, the mechanisms 50 and 60 operate basically in the same manner as those of the embodiment 1.

Figure 14:
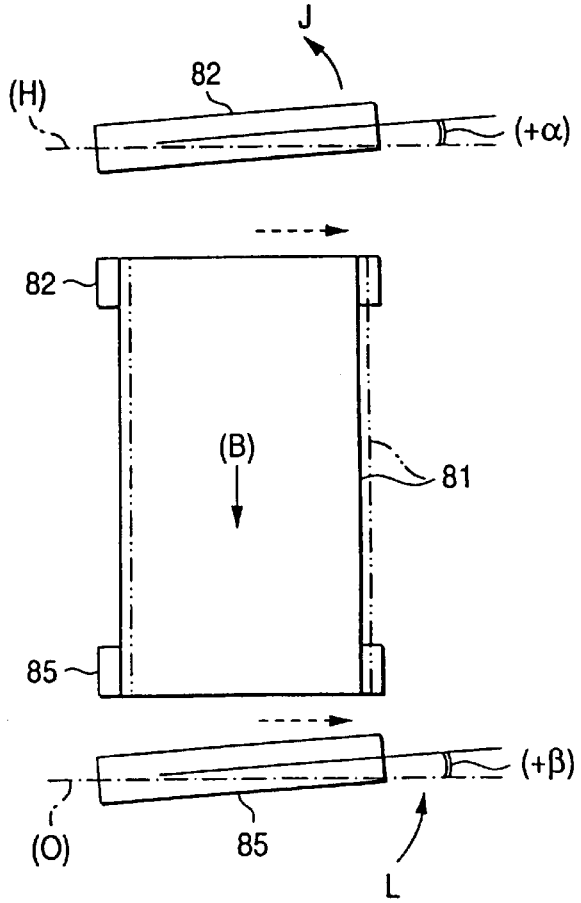
FIG. 14 is a view illustrating a state of the sheet conveyer/transfer belt mechanism when the steering mechanism is in operation (tension is increasing) and the tension correction mechanism is in operation.
Figure 15:
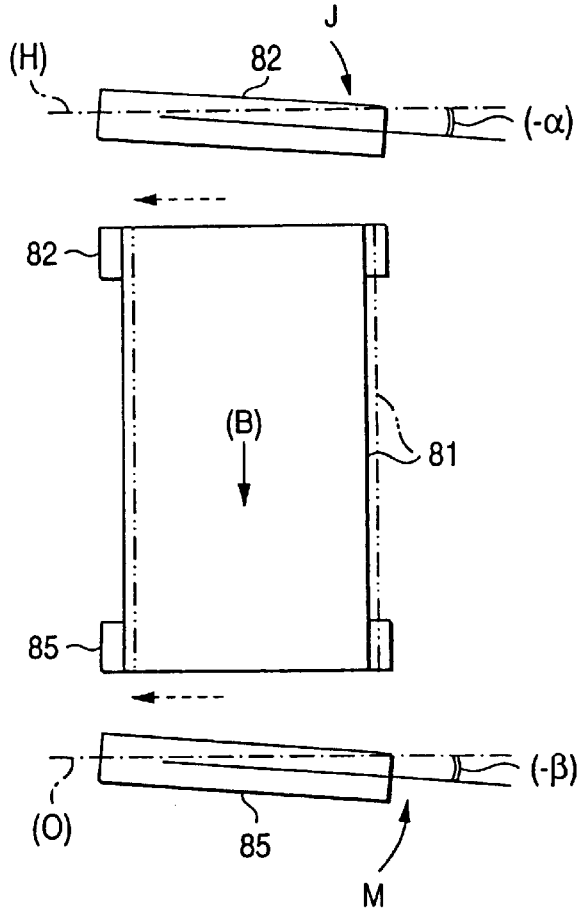
FIG. 15 is a view illustrating a state of the sheet conveyer/transfer belt mechanism when the steering mechanism is in operation (tension is decreasing) and the tension correction mechanism is in operation.

FIGS. 14 and 15 illustrate behaviors of the sheet conveyer/transfer belt 81 of when the tension roll 85 is inclined by a correction angle β by the tension correction mechanism 60 (being interlocked to the operation of the steering mechanism 50 for displacing the drive roll 22).

Referring to FIG. 14, when the drive roll 82 is displaced in the adjusting direction J by a tension angle +α, the tension roll 85 is inclined by a correction angle +β so as to be displaced in the correction direction L. Then, the sheet conveyer/transfer belt 81 runs being displaced toward an end of the drive roll 22 that is displaced in the adjusting direction J from the horizontal reference position H as denoted by a two-dot chain line and, at the same time, runs being displaced toward an end of the tension roll 85 that is displaced in the adjusting direction L from the central reference position O to decrease the belt tension. As a result, the tension of the sheet conveyer/transfer belt 81 increases on the side of the drive roll 82 that is displaced in the adjusting direction J, but a change in the tension is canceled by the tension roll 85 that is displaced in the correction direction L in which the tension decreases, and the belt 81 is not twisted.

On the other hand, when the drive roll 82 is displaced in the adjusting direction K by a tension angle −α, the tension roll 85 is inclined by a correction angle −β so as to be displaced in the correction direction M. Then, the sheet conveyer/transfer belt 81 runs being displaced toward an end on the side opposite to the end of the drive roll 82 that is displaced in the adjusting direction K from the horizontal reference position H as denoted by a two-dot chain line and, at the same time, runs being displaced toward an end of the tension roll 85 that is displaced in the adjusting direction M from the central reference position O to increase the belt tension. As a result, the tension of the belt 81 decreases on the side of the drive roll 82 that is displaced in the adjusting direction K, but a change in the tension is canceled by the tension roll 85 that is displaced in the correction direction M in which the tension increases, and the belt 81 is not twisted.

According to the image-forming apparatus of the embodiment 2, the sheet conveyer/transfer belt 81 that may happen to run in a zigzag manner or being deviated to one side of the rolls, is adjusted for its running state by the operation of the steering mechanism 50 to run in a normal state. Besides, the tension correction mechanism 60 operates being interlocked to the operation of the steering mechanism 50, correcting a change in the tension of the belt stemming from the operation of the steering mechanism 50 and preventing the belt from being twisted due to a change in the tension thereof. Therefore, the toner images formed by the image-forming units 10 are favorably transferred onto a correct transfer position on the recording sheet P that is conveyed being adsorbed by the sheet conveyer/transfer belt 81 without distorted or skewed. Even in forming a full-color image, there occurs no defect in the picture quality such as color deviation or color shading, that stems from a defective running of the intermediate transfer belt 81.

Embodiment 3

Figure 16:
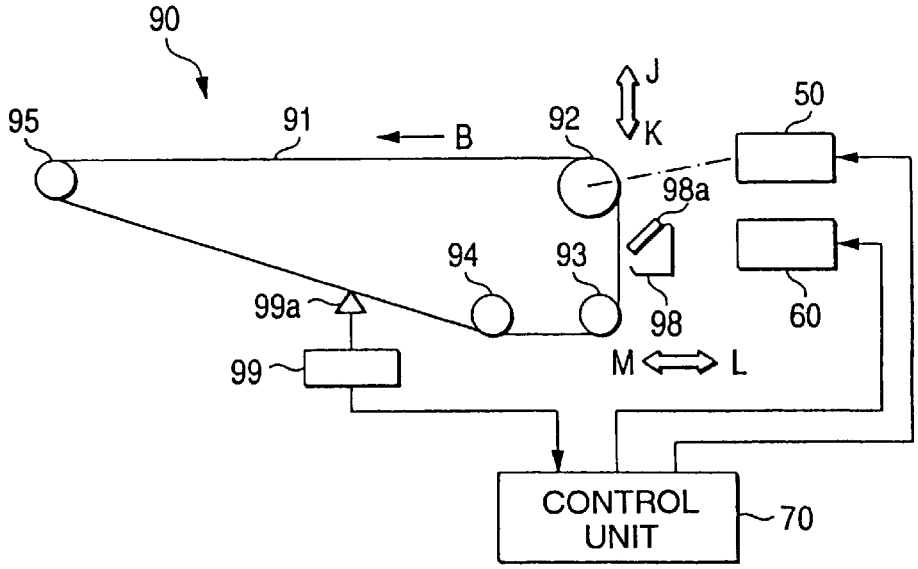
FIG. 16 is a view illustrating the constitution of the sheet conveyer/transfer belt according to an embodiment 3.

FIG. 16 illustrates an embodiment 3 of the invention, and is a view illustrating the belt running mechanism employed by the image-forming apparatus of the embodiment 3. The image-forming apparatus of the embodiment 3 is constituted in the same manner as the image-forming apparatus of the embodiment 2 with the exception of, for example, using a sheet conveyer/transfer belt mechanism 90 instead of the sheet conveyer/transfer belt mechanism 80 of the embodiment 2.

In the sheet conveyer/transfer belt mechanism 90 employed in this embodiment, the sheet conveyer/transfer belt 91 which is an endless belt is tightly stretched round a drive roll 92, driven rolls 93, 94 and a tension roll 95, and runs in the direction of an arrow B due to the rotational force of the drive roll 92. The rolls are rotatably supported by bearings. In FIG. 16, reference numeral 98 denotes a belt cleaner provided with a cleaning blade 98*a* that is so disposed as to come into contact with the sheet conveyer/transfer belt 91, and 99 denotes a detector including a sensor unit 99*a* for detecting the presence of a belt home mark formed on a side end of the sheet conveyer/transfer belt 91 and the position of the belt edge.

The sheet conveyer/transfer belt mechanism 90 is provided with a steering mechanism 50 for adjusting the running state of the sheet conveyer/transfer belt 91 by displacing an end of the drive roll 92 in the predetermined adjusting directions J, K, and with a tension correction mechanism 60 for correcting a change in the tension of the sheet conveyer/transfer belt 91 caused by the operation of the steering mechanism 50 for displacing the drive roll 92 by displacing one of the ends of the cleaning blade 98*a* of the belt cleaner along the predetermined correction directions L, M nearly in the same manner as the belt mechanism 80 of the embodiment 2.

The drive roll 92 and the steering mechanism 50 in the belt mechanism 90 are constituted nearly in the same manner as the drive roll 82 and the steering mechanism 50 in the belt mechanism 80 of the embodiment 2 (see FIGS. 2 to 4). In the tension correction mechanism 60 as shown in FIG. 17, either end of the cleaning blade 98*a* coming in contact with the sheet conveyer/transfer belt 91 is pushed onto the belt 81 with a force stronger or weaker than the force of during the normal operation thereby to increase or decrease the contacting pressure. That is, the cleaning blade 98*a* is displaced in a correction direction M in which it separates away from the belt 91 to produce a contacting pressure E1 smaller than the contacting pressure (dotted arrow) E0 of during the normal operation, or is displaced in a correction direction M in which the blade 98*a* bites into the belt 91 to produce a contacting pressure E2 larger than the contacting pressure E0 of during the normal operation. Further, the steering mechanism 50 and the tension correction unit 60 in the belt mechanism 90 are connected to the control unit 70 like in the embodiment 2, and the operations are controlled by the control unit 70.

Next, described below are operations of the steering mechanism 50 and of the tension correction unit 60 in the sheet conveyer/transfer belt mechanism 90.

In this image-forming apparatus, the tension correction mechanism 60 operates being interlocked to the operation of the steering mechanism 50 for displacing the drive roll 92, so that the cleaning blade 98*a* is displaced in the predetermined correction directions L, M thereby to correct a change in the tension of the sheet conveyer/transfer belt 91 caused by the operation of the steering mechanism 50 for displacing the drive roll 92. Here, the mechanisms 50 and 60 operate basically in the same manner as those of the embodiment 2.

Figure 17A:
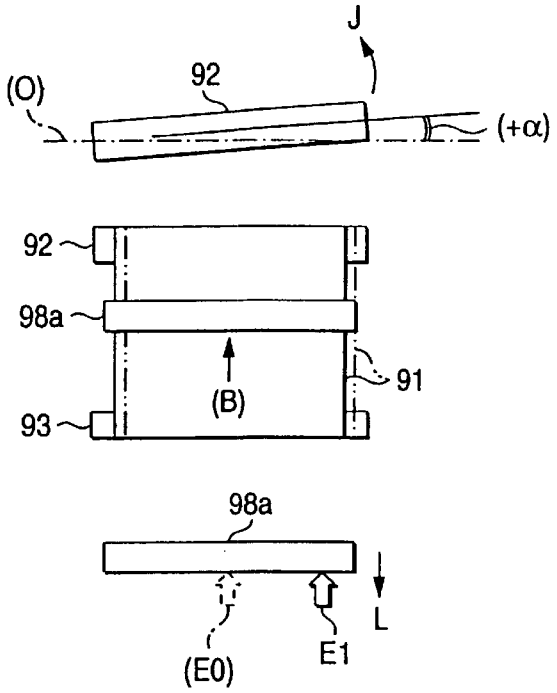
FIGS. 17A and 17B are views illustrating a state of the sheet conveyer/transfer belt mechanism when the steering mechanism is in operation (tension is increasing or decreasing) and the tension correction mechanism is in operation.

Referring to FIG. 17*a*, when the drive roll 92 is displaced by the steering mechanism 50 in the adjusting direction J by a tension angle $+\alpha$, the cleaning blade 98*a* is displaced by the tension correction mechanism 60 in the correction direction L. Then, the sheet conveyer/transfer belt 91 runs being displaced toward an end of the drive roll 22 that is displaced in the adjusting direction J from the horizontal reference position H as denoted by a two-dot chain line and, at the same time, runs being displaced toward an end of the cleaning blade 98*a* that is displaced in the adjusting direction L to decrease the belt tension. As a result, the tension of the sheet conveyer/transfer belt 91 increases on the side of the drive roll 92 that is displaced in the adjusting direction J, but a change in the tension is canceled by the cleaning blade 98*a* that is displaced in the correction direction L in which the tension decreases, and the belt 91 is not twisted.

Figure 17B:
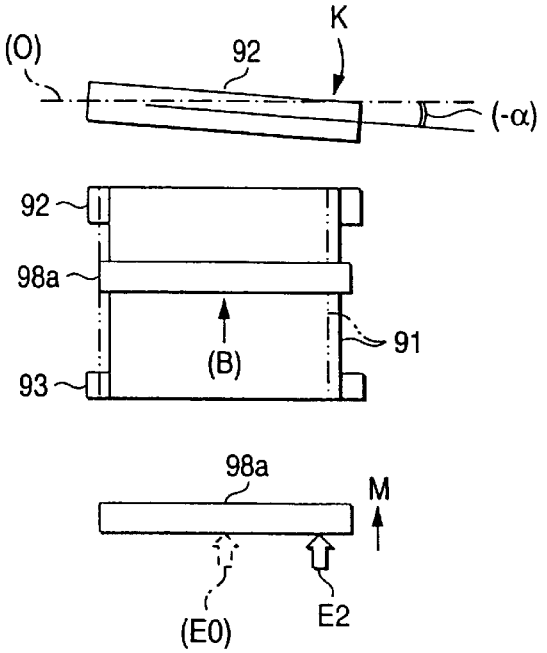
Figure 18:
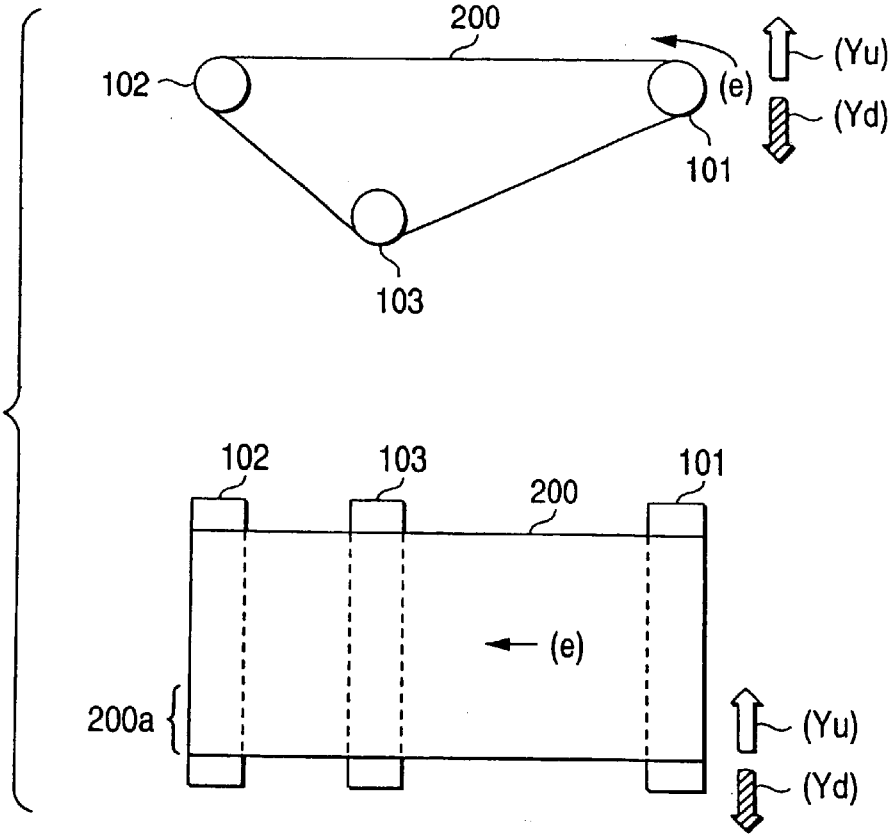
FIG. 18 is a view schematically illustrating the constitution of a conventional belt running mechanism.
Figure 19:
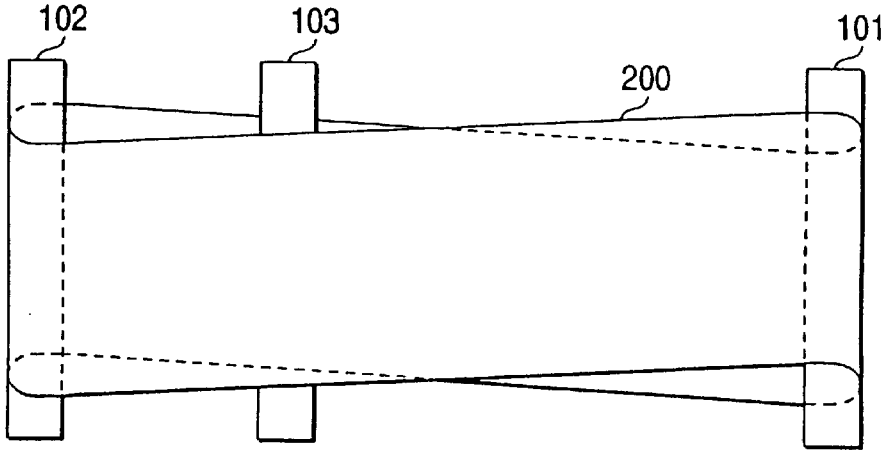
FIG. 19 is a view schematically illustrating a belt-twisting phenomenon in the conventional belt running mechanism.

As shown in FIG. 17*b*, on the other hand, when the drive roll 92 is displaced by the steering mechanism 50 in the adjusting direction K by a tension angle $-\alpha$, the cleaning blade 98*a* is displaced by the tension correction mechanism 60 in the correction direction M. Then, the sheet conveyer/transfer belt 91 runs being displaced toward an end on the side opposite to the end of the drive roll 92 that is displaced in the adjusting direction K from the horizontal reference position H as denoted by a two-dot chain line and, at the same time, runs being displaced toward an end of the cleaning blade 98*a* that is displaced in the adjusting direction M to increase the belt tension. As a result, the tension of the belt 91 decreases on the side of the drive roll 92 that is displaced in the adjusting direction K, but a change in the tension is canceled by the cleaning blade 98*a* that is displaced in the correction direction M in which the tension increases, and the belt 91 is not twisted.

Other Embodiments

The embodiments have dealt with the cases where there were employed plural image-forming units 10. The invention, however, can also be applied to even when there is employed only one image forming unit 10. Further, the embodiments have dealt with the cases of when there were employed an intermediate transfer belt and a sheet conveyer/transfer belt as endless belts. However, the endless belt may be a photosensitive belt.

According to the image-forming apparatus of the invention as described above, the belt running state is adjusted by displacing one of the rolls supporting the endless belt in order to easily and reliably prevent the belt from being twisted by a change in the tension of the endless belt that stems from the operation for displacing the roll. Therefore, the image-forming apparatus forms favorable images without defect in the picture quality that is caused by the zigzag running or twisted running of the endless belt.

What is claimed is:

1. A method of adjusting running of a belt, comprising:

detecting a running state of an endless belt;

moving an end of a first member supporting the endless belt based upon the detected running state to adjust the running state of the endless belt when the running state is out of a tolerance range; and moving an end of a second member in contact with the endless belt based on moving the end of the first member to substantially evenly distribute the tension across the endless belt.

2. The method of claim 1, wherein the running state and the tension are adjusted simultaneously.

3. An apparatus for adjusting running of a belt, comprising:

an endless belt;

a running state detector for the endless belt;

a plurality of support members that support the endless belt;

a running state adjusting member that adjusts the running state of the endless belt, based upon a running state detected by the running state detector, by moving an end of at least one of the plurality of support members; and a tension adjusting member that adjusts tension of the endless belt by moving an end of a tension member such that the tension across the endless belt is substantially evenly distributed and an average belt tension is substantially the same as it was prior to running state correction.

4. An image-forming apparatus including the apparatus for adjusting running of the belt of claim 3.

5. The image-forming apparatus of claim 4, wherein the endless belt is a belt-type photosensitive member.

6. The image-forming apparatus of claim 4, wherein the endless belt is a transfer member conveyer belt.

7. The image-forming apparatus of claim 4, wherein the endless belt is an intermediate transfer belt.

8. The apparatus of claim 3, wherein the support members are rotatable roll members.

9. The apparatus of claim 3, wherein at least one of the plural support members also serves as a tension adjusting member.

10. The apparatus of claim 9, wherein the support member on which the running state adjusting member operates is different from the tension adjusting member.

11. The apparatus of claim 3, wherein the tension adjusting member is a blade-type member.

12. The apparatus of claim 11, wherein the tension adjusting member is a cleaning blade.

13. The apparatus of claim 3, wherein a locus of motion of an end of the support member is a straight line.

14. The apparatus of claim 3, wherein a locus of motion of an end of the support member is an arc with the other end thereof for its center.

* * * * *